US006883471B1

(12) United States Patent
Belter et al.

(10) Patent No.: US 6,883,471 B1
(45) Date of Patent: Apr. 26, 2005

(54) VORTEX ENHANCED COOLING FOR AN INTERNAL COMBUSTION ENGINE

(75) Inventors: David J. Belter, West Bend, WI (US); John O. Scherer, III, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/731,834

(22) Filed: Dec. 9, 2003

(51) Int. Cl.[7] ..... F02B 75/18
(52) U.S. Cl. ..... 123/41.74
(58) Field of Search ..... 123/41.74, 41.72, 123/41.81, 41.79

(56) References Cited

U.S. PATENT DOCUMENTS 5,188,071 A * 2/1993 Han ..... 123/195 R
5,474,040 A * 12/1995 Murakami et al. ..... 123/195 R
5,887,556 A 3/1999 Kim
6,298,899 B1 * 10/2001 Baltz et al. ..... 164/28
6,776,127 B1 * 8/2004 Osman ..... 123/41.72

* cited by examiner

*Primary Examiner*—Henry C. Yuen
*Assistant Examiner*—Hyder Ali
(74) *Attorney, Agent, or Firm*—William D. Lanyi

(57) ABSTRACT

A cavity is provided at a bend in a cooling passage near a bore bridge region between cylinders of an internal combustion engine. The cavity can be provided with a downstream protuberance which induces a portion of the stream of coolant within the cooling passage to join a vortical flow of coolant within the cavity. An upstream protuberance can be provided to align a portion of the vortical flow within the cavity with the stream of coolant within the cooling passage in order to facilitate the return of the vortical flow back into the stream of coolant within the cooling passage.

17 Claims, 5 Drawing Sheets

VORTEX ENHANCED COOLING FOR AN INTERNAL COMBUSTION ENGINE

BACKGROUND OF THE INVENTION

1. Field of the Invention

The present invention is generally related to a cooling system of an internal combustion engine and, more particularly, to a cooling system that uses vortex enhancing cavities to improve the thermal communication between a stream of coolant and a region of the engine proximate a bore bridge between adjacent cylinders.

2. Description of the Prior Art

Certain types of engines comprise a plurality of cylinders that include bore bridges between them without any coolant path provided through the bore bridges. In engines of this type, a coolant is directed along the sides of an aligned plurality of cylinders without any coolant being directed between the cylinders or through the bore bridge.

U.S. Pat. No. 5,887,556, which issued to Kim on Mar. 30, 1999, describes a device for forming vortex in cooling water for cylinders. A device is provided for generating a vortex in cooling water for cylinders of internal combustion engines. In the device, a steel casing is inserted into the bottom portion of a cooling water passage of a cylinder head. The steel casing is comprised of inner and outer rings, with an annular cavity being formed between the two rings and allowing engine oil to pass through. A plurality of pressure units are radially mounted to the inner ring. Each of the pressure units is radially movable in opposite directions in response to the pressure of the engine oil in the annular cavity, thus forming vortex in the cooling water passing through the inner ring. The device of this enlarges the cooling water contact water area of the cylinder, thereby improving the cylinder cooling effect and increasing the engine output power.

The patent described above is hereby expressly incorporated by reference in the description of the present invention.

When the cylinders of an internal combustion engine are aligned without cooling passages therebetween, the region of the engine between the cylinders must rely on cooling from streams of coolant that are not in immediate thermal contact with the bore bridges. In situations like this, it is important that the velocity of coolant in the nearest cooling channels be sufficiently high to remove heat from the bore bridge as efficiently as possible. It is also important, when an open cooling system is used, that the velocity of the coolant be sufficiently high to remove corrosion products and hard water deposits from the cooling surfaces. Otherwise, these deposits can act as thermal insulators.

SUMMARY OF THE INVENTION

A cooling system for an engine, made in accordance with the preferred embodiment of the present invention, comprises an engine having a plurality of cylinders which are aligned with each other without a coolant conduit extending completely between adjacent ones of the plurality of cylinders. It also comprises a first cooling passage configured to direct a first stream of coolant in thermal communication with each of the plurality of cylinders. A cavity is formed adjacent to and in fluid communication with the first cooling passage. The cavity is shaped to induce and enhance the formation of a vortex. The present invention further comprises a downstream protuberance formed at an intersection of a surface of the first cooling passage and a surface of the cavity in order to induce a portion of the first stream of coolant within the first cooling passage to join a vortical flow of coolant within the cavity. It also comprises an upstream protuberance formed at a second intersection of the surface of the first cooling passage and the surface of the cavity in order to align a portion of the vortical flow within the cavity with the first stream of coolant within the first cooling passage to facilitate the return of the portion of the vortical flow within the cavity back into the first stream of coolant within the first cooling passage.

The plurality of cylinders is aligned along an axis which extends through the centers of each of the cylinders. The first cooling passage changes direction at a first region from a first direction which is generally toward the axis to a second direction which is generally away from the axis. The cavity is disposed proximate the first region. The cooling system is an open cooling system in a preferred embodiment, wherein water is drawn from a body of water and directed into the first cooling passage and then returned to the body of water. The cylinders are configured with solid bore bridges therebetween. A second cooling passage can be configured to direct a second stream of coolant in thermal communication with each of the plurality of cylinders.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
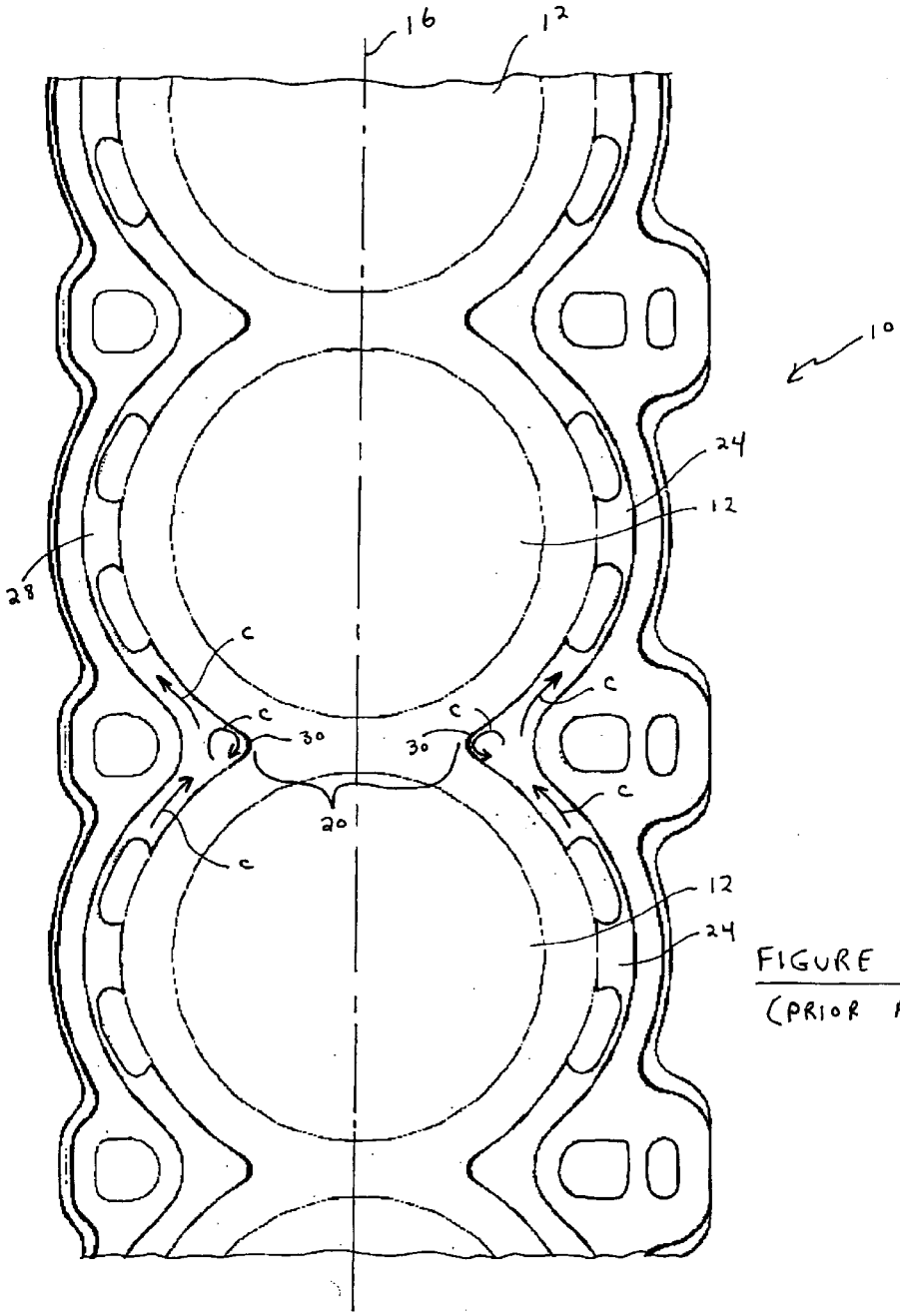
FIGURE 1 (PRIOR ART)
FIG. 1 illustrates an engine with a bore bridge construction.

Throughout the description of the preferred embodiment of the present invention, like components will be identified by like reference numerals.

FIG. 1 shows a portion of an engine 10 showing a plurality of cylinders 12 aligned along an axis 16. A bore bridge 20 is located between each adjacent pair of cylinders 12. The bore bridge does not have any conduit extending through it to conduct coolant in intimate thermal communication with the cylinders 12. A first cooling passage 24 is configured to direct a first stream of coolant, represented by arrows C, in thermal communication with each of the plurality of cylinders 12. A second cooling passage 28 is provided to direct a second stream of coolant in thermal communication with each of the plurality of cylinders 12.

With continued reference to FIG. 1, it can be seen that the bore bridge region 20 represents a relatively large mass of metal that is not disposed in direct or close proximity to either of the first and second cooling passages 24 and 28. As a result, heat passing into the bore bridge 20 from the cylinders 12 is not easily removed by the coolant flowing through the first and second cooling passages. As can be seen in FIG. 1, small vortices of coolant can be formed at the bends 30 in the first and second cooling passages, 24 and 28.

One disadvantage of a design similar to that shown in FIG. 1 is that the bore bridge 20 might achieve excessive temperatures when the engine is operating. These excessive temperatures can be the result of the distance between portions of the bore bridge 20 and the first and second cooling passages, 24 and 28. The temperature of the bore bridge 20 normally reaches higher magnitudes than the other portions of the engine. This increased temperature might result in thermal expansion of the bore bridge region which can stress this region beyond its yield point. When the engine is deactivated and the bore bridge 20 cools to atmospheric temperatures, the thermal expansion is alleviated and the bore bridge attempts to return to its original state. This heating and cooling of the bore bridge 20, if excessive temperatures are achieved, can result in a fatigue condition that could result in a degradation of the engine. It is therefore beneficial if the bore bridge 20 can be maintained at temperatures that are lower than those which would result in this type of thermal fatigue condition.

Figure 2:
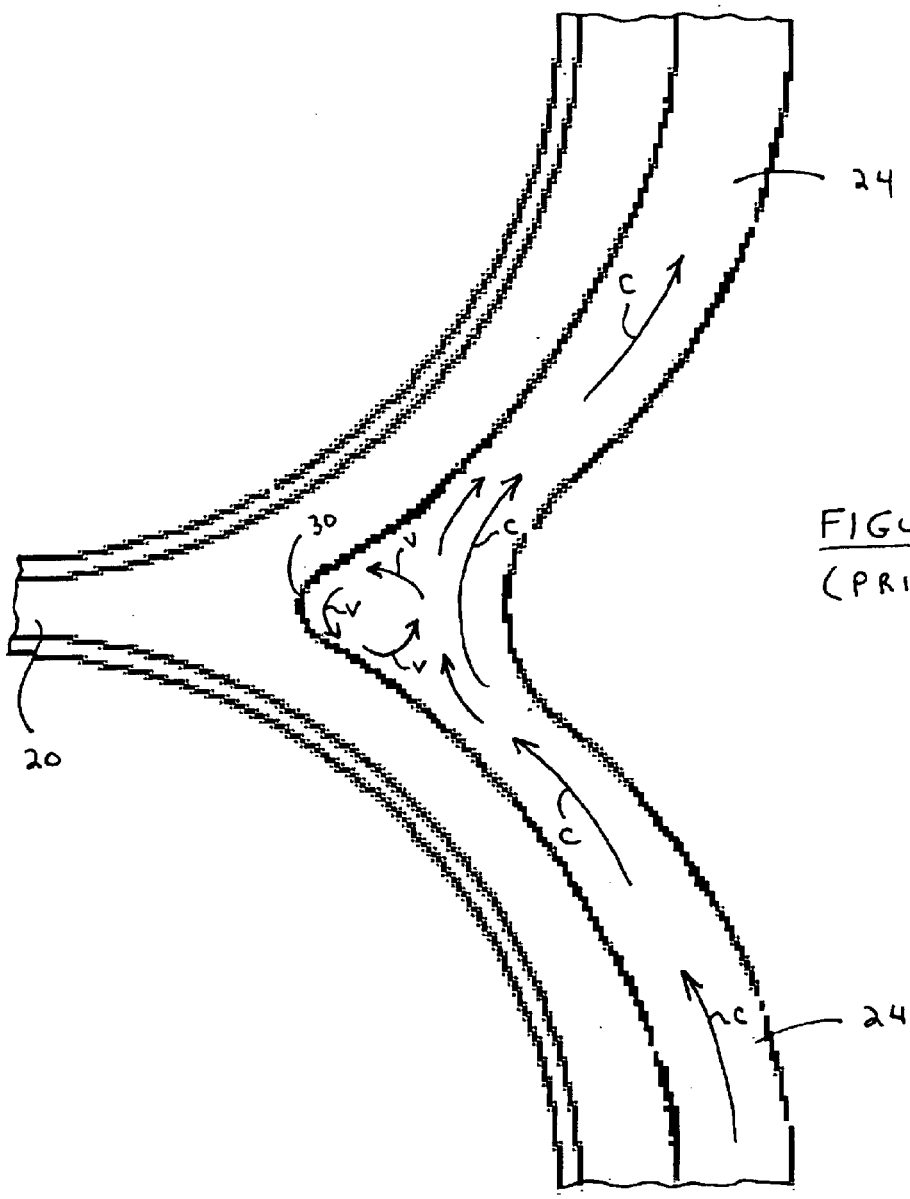
FIGURE 2 (PRIOR ART)
FIG. 2 is an enlarged portion of FIG. 1.

FIG. 2 is an enlarged illustration of a portion of FIG. 1. The arrows in FIG. 2 represent the first stream of coolant C and a region, within the bend 30, where vortical flow V occurs. The vortical flow V occurs at a lower velocity than the coolant flow C within the first cooling passage 24. As a result, the vortical flow V is inherently less efficient in removing calories from the region of the bend 30 than the first stream of coolant C as it flows through the first cooling passage 24. The vertical flow V occurs naturally, given the coolant passage geometry, but the velocities within the vertical flow are typically much less than those in the main cooling passage C. The low velocities in the natural vertical flow reduce heat transfer along the neighboring walls.

Figure 3:
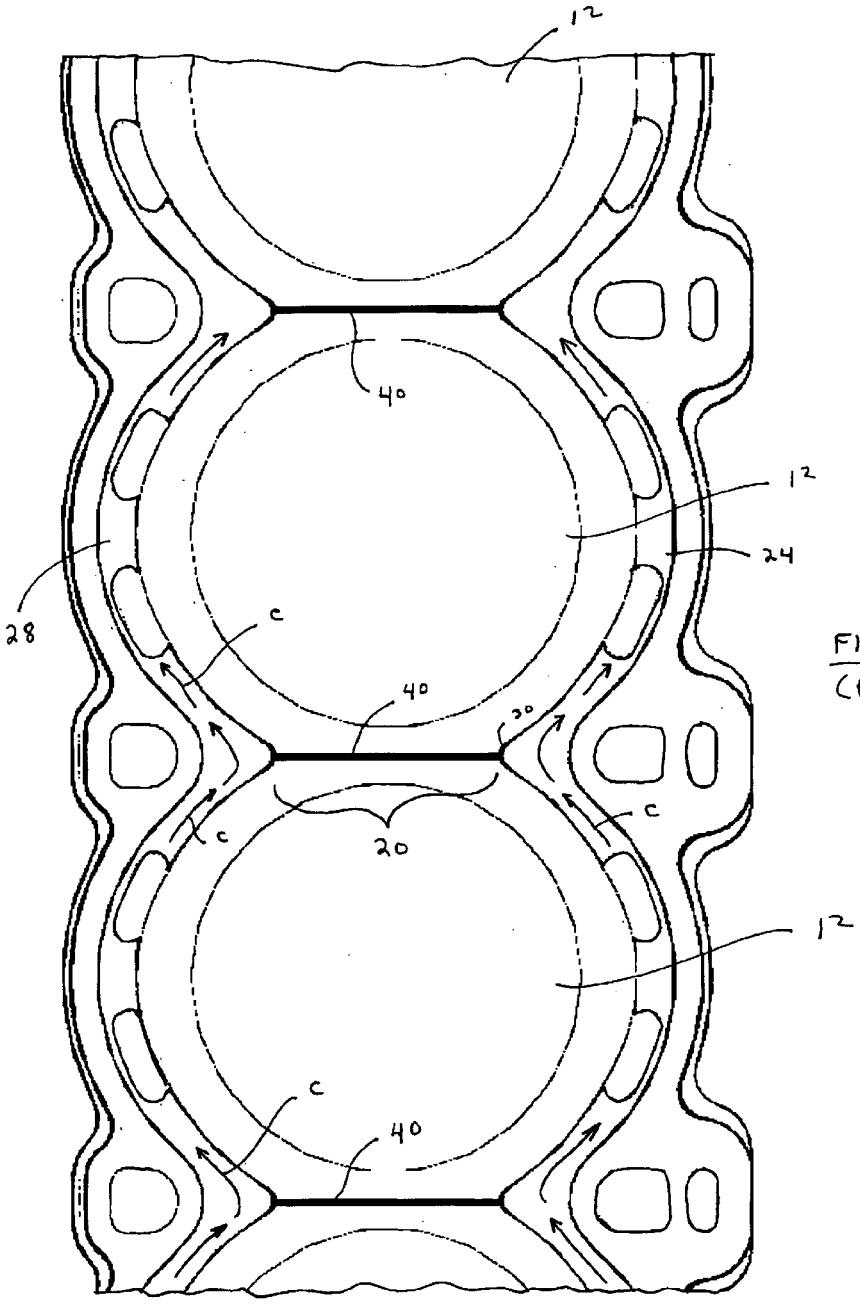
FIGURE 3 (PRIOR ART)
FIG. 3 shows a saw cut method for improving cooling of the bore bridge region between cylinders.

It is helpful to understand the ways that are currently known to those skilled in the art for improving the heat transfer characteristics of an engine such as that shown in FIG. 1. FIG. 3 shows the engine in FIG. 1, but with a plurality of saw cuts 40 extending through the bore bridge regions 20 between pairs of cylinders 12. In certain applications, these saw cuts 40 could allow coolant to pass between the cylinders 12 and improve the cooling of the bore bridge 20. However, when the streams of coolant C of the first and second cooling passages, 24 and 28, are directed in parallel paths as shown in FIGS. 1 and 3, insufficient pressure differential between the first and second, cooling passages, 24 and 28, exists to induce the flow of coolant through the saw cuts 40. As a result, any coolant that flows into the saw cuts 40 typically boils because of the heat of the bore bridge region 20 and because additional coolant is not supplied into the saw cut region at sufficient quantities to act as an efficient cooling stream.

Figure 4:
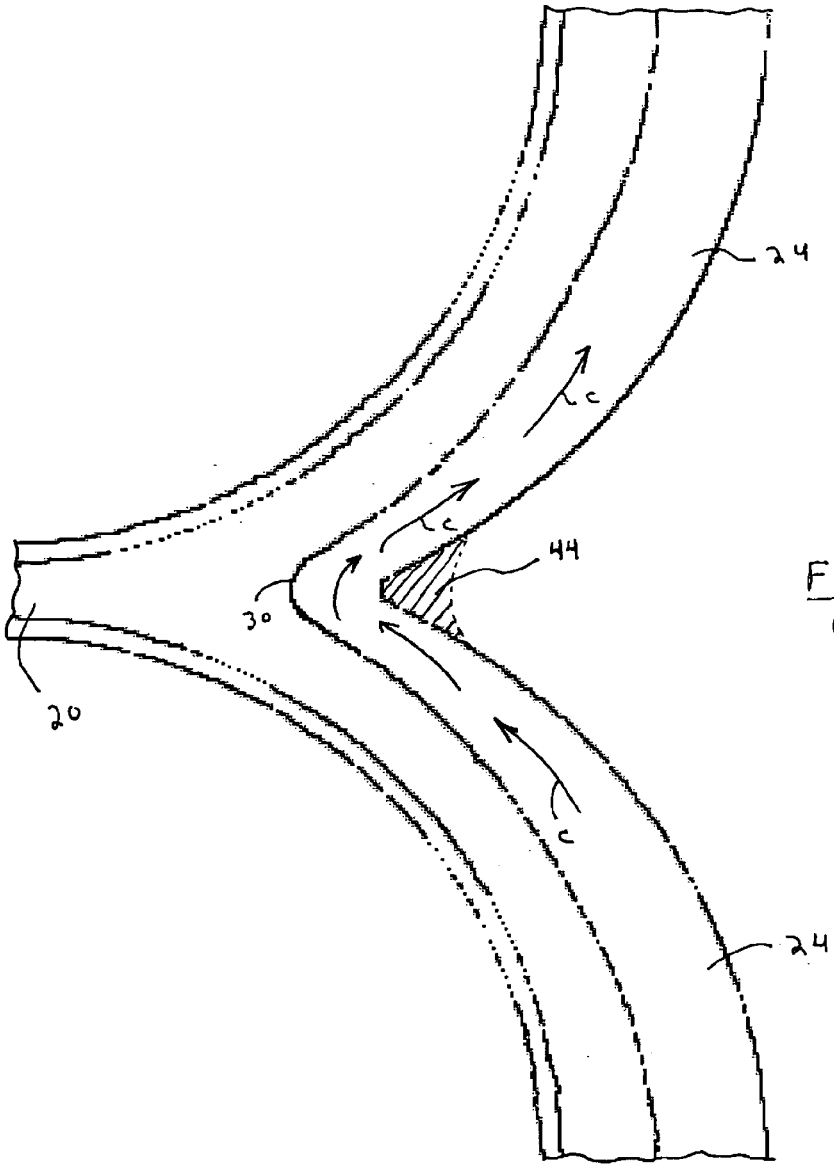
FIGURE 4 (PRIOR ART)
FIG. 4 shows a cross-sectional decrease in cooling passage area to increase the velocity of coolant through a bend region of the cooling passage.

FIG. 4 shows one known method for increasing the velocity of the coolant C as it passes through the first cooling passage 24. The region identified by reference numeral 44 is built up at the inside surface of the bend 30 to decrease the width of the first cooling passage 24 in the region of the bend 30. This decreased cross-sectional area at the bend causes the coolant C to increase its velocity as it passes through the region of the bend 30. The built up 44 is identified by crosshatching to show the difference between the configuration shown in FIG. 4 and the configuration shown in FIG. 2. Although the technique illustrated in FIG. 4 increases the velocity of the coolant C as it passes through the region of the bend 30, it also results in a sufficiently high pressure drop within the cooling stream that total fluid flow is deleteriously reduced. As a result, a technique such as that shown in FIG. 4 requires a significantly higher pumping capacity in the cooling system.

Figure 5:
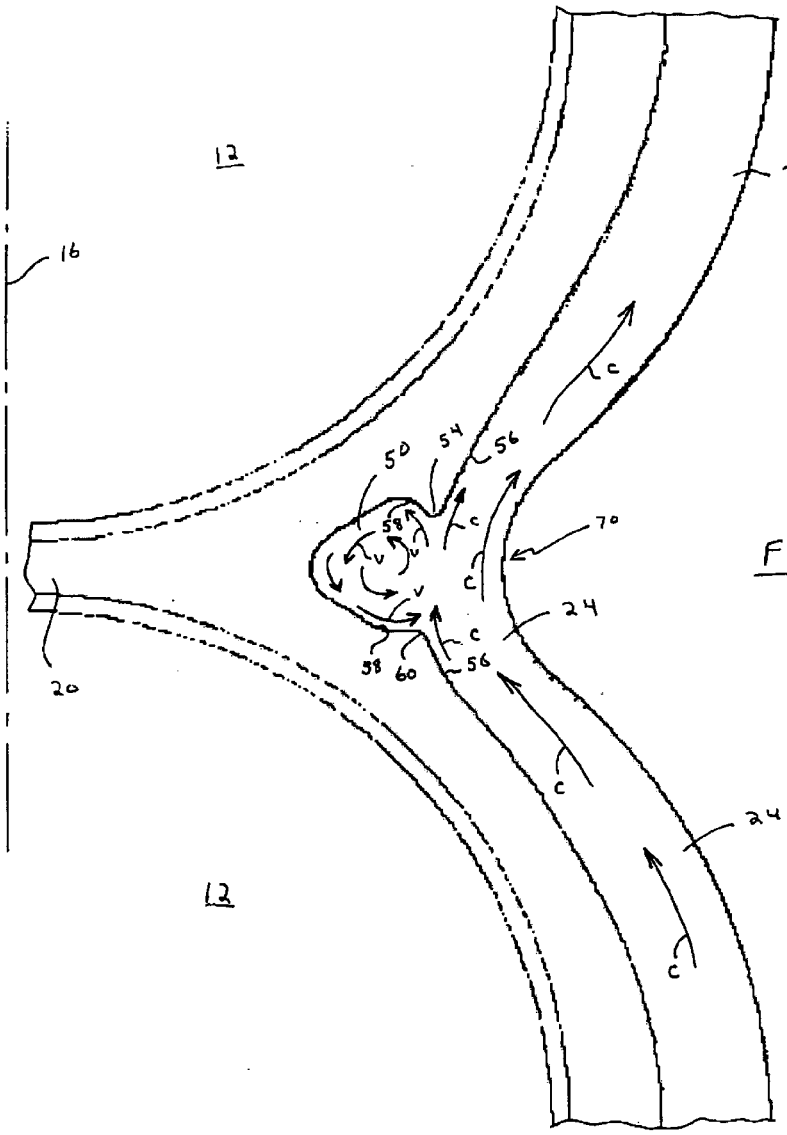
FIG. 5 shows the preferred configuration of the present invention.

FIG. 5 is an enlarged view of the same section of the engine shown in FIGS. 2 and 4, but with the present invention provided to improve the cooling efficiency of the engine. A cavity 50 is formed adjacent to and in fluid communication with the first cooling passage 24. It is provided with a downstream protuberance 54 formed at an intersection of a surface 56 of the first cooling passage 24 and a surface 58 of the cavity 50. The downstream protuberance 54 is provided to induce a portion of the first stream of coolant C within the first cooling passage 24 to join a vortical flow V of coolant within the cavity 50. This is represented by the divergence of the coolant arrow C and vortical flow arrow V most proximate the downstream protuberance 54. A portion of the flow is thus diverted into the cavity 50 at a rate which is greater than would normally occur in an arrangement such as that shown in FIG. 2.

The present invention further comprises an upstream protuberance 60 formed at a second intersection of the surface 56 of the first cooling passage 24 and the surface 58 of the cavity 50. The purpose of the upstream protuberance 60 is to align a portion of the vortical flow within the cavity 50 with the first stream of coolant C within the first cooling passage 24 for the purpose of facilitating the return of the portion of the vortical flow V within the cavity 50 back into the first stream of coolant C within the first cooling passage 24. This is represented by the vortical flow arrow V being aligned in a partially upward direction in FIG. 5 to be more aligned with the coolant flow, represented by arrow C most proximate the upstream protuberance 60. This prevents the merging of two streams of liquid in generally opposite directions, as would otherwise occur without the provision of the upstream protuberance 60. The two protuberances also stabilize the vortex in position, thus reducing turbulent dissipation and allowing it to build in strength.

As described above, the plurality of cylinders 12 is aligned with an axis 16 which extends through the centers of the cylinders. The first cooling passage 24 changes direction at a first region, identified by reference numeral 70 in FIG. 5, from a first direction which is generally toward the axis 16 to a second direction which is generally away from the axis 16. As can be seen in FIG. 5, the first cooling passage 24 directs the flow of coolant C in an upward direction below the first region 70 which turns noticeably in a direction toward the axis 16. Above the first region 70, the flow of coolant C turns away from the axis 16. This area was described above as the bend 30 in the first cooling passage 24. The cavity 50 is disposed proximate the first region 70 where the bend 30 was shown in FIG. 1.

The present invention is particularly useful in an open cooling system where water is drawn from a body of water, directed into the first cooling passage 24, and then returned to the body of water. The present invention is also particularly useful in an engine configured with solid bore bridges 20 between the cylinders 12. Although the present invention has been described in particular detail in relation to the first cooling passage 24, it should be understood that a symmetrical cooling passage 28 would be similarly configured.

The provision of the cavity 50, with its downstream 54 and upstream 60 protuberances, enhances the formation of vortical flow V within the cavity 50. This increases the velocity of flow within the cavity and improves its thermal efficiency in removing calories from the bore bridge 20.

Although the present invention has been described in particular detail to show a preferred embodiment and illustrated with specificity to show particular characteristics of the present invention, it should be understood that alternative embodiments are also within its scope.

We claim:

1. A cooling system for an engine, comprising:

an engine having a plurality of cylinders, said plurality of cylinders being aligned with each other without a coolant conduit extending completely between adjacent ones of said plurality of cylinders, said plurality of cylinders being aligned along an axis which extends through the centers of said plurality of cylinders, said first cooling, passage changing direction at a first region from a first direction generally toward said axis to a second direction generally away from said axis;

a first cooling passage configured to direct a first stream of coolant in thermal communication with each of said plurality of cylinders;

a cavity formed adjacent to and in fluid communication with said first cooling passage; and a downstream protuberance, formed at a first intersection of a surface of said first cooling passage and a surface of said cavity, to induce a portion of said first stream of coolant within said first cooling passage to join a vortical flow of coolant within said cavity.

2. The system of claim 1, further comprising:

an upstream protuberance, formed at a second intersection of said surface of said first cooling passage and said surface of said cavity, to align a portion of said vortical flow within said cavity with said first stream of coolant within said first cooling passage to facilitate the return of said portion of said vortical flow within said cavity back into said first stream of coolant within first cooling passage.

3. The system of claim 2, wherein:

said cavity is disposed proximate said first region.

4. The system of claim 1, wherein:

said cooling system is an open cooling system wherein water is drawn from a body of water, directed into said first cooling passage, and then returned to said body of water.

5. The system of claim 1, wherein:

said cylinders are configured with solid bore bridges therebetween.

6. The system of claim 1, further comprising:

a second cooling passage configured to direct a second stream of coolant in thermal communication with each of said plurality of cylinders.

7. A cooling system for an engine, comprising:

an engine having a plurality of cylinders, said plurality of cylinders being aligned with each other without a coolant conduit extending completely between adjacent ones of said plurality of cylinders;

a first cooling passage configured to direct a first stream of coolant in thermal communication with each of said plurality of cylinders, said cooling system being an open cooling system, wherein water is drawn from a body of water, directed into said first cooling passage, and then returned to said body of water, a vortex enhancing cavity formed adjacent to and in fluid communication with said first cooling passage; and an upstream protuberance, formed at a second intersection of said surface of said first cooling passage and said surface of said cavity, to align a portion of said vortical flow within said cavity with said first stream of coolant within said first cooling passage to facilitate the return of said portion of said vortical flow within said cavity back into said first stream of coolant within first cooling passage.

8. The system of claim 7, wherein:

a downstream protuberance, formed at a first intersection of a surface of said first cooling passage and a surface of said cavity, to induce a portion of said first stream of coolant within said first cooling passage to join a vortical flow of coolant within said cavity, said cylinders being configured with solid bore bridges therebetween.

9. The system of claim 8, wherein:

said plurality of cylinders is aligned along an axis which extends through the centers of said plurality of cylinders.

10. The system of claim 9, wherein:

said first cooling passage changes direction at a first region from a first direction generally toward said axis to a second direction generally away from said axis.

11. The system of claim 10, wherein:

said cavity is disposed proximate said first region.

12. The system of claim 11, further comprising:

a second cooling passage configured to direct a second stream of coolant in thermal communication with each of said plurality of cylinders.

13. A cooling system for an engine, comprising:

an engine having a plurality of cylinders, said plurality of cylinders being aligned with each other, said cylinders being configured with solid bore bridges therebetween without a coolant conduit extending completely between adjacent ones of said plurality of cylinders;

a first cooling passage configured to direct a first stream of coolant in thermal communication with each of said plurality of cylinders, said cooling system being an open cooling system, wherein water is drawn from a body of water, directed into said first cooling passage, and then returned to said body of water, a vortex enhancing cavity formed adjacent to and in fluid communication with said, first cooling passage;

a downstream protuberance, formed at a first intersection of a surface of said first cooling passage and a surface of said cavity, to induce a portion of said first stream of coolant within said first cooling passage to join a vortical flow of coolant within said cavity;

an upstream protuberance, formed at a second intersection of said surface of said first cooling passage and said surface of said cavity, to align a portion of said vortical flow within said cavity with said first stream of coolant within said first cooling passage to facilitate the return of said portion of said vortical flow within said cavity back into said first stream of coolant within first cooling passage.

14. The system of claim 13, wherein:

said plurality of cylinders is aligned along an axis which extends through the centers of said plurality of cylinders.

15. The system of claim 14, wherein:

said first cooling passage changes direction at a first region from a first direction generally toward said axis to a second direction generally away from said axis.

16. The system of claim 15, wherein:

said cavity is disposed proximate said first region.

17. The system of claim 16, further comprising:

a second cooling passage configured to direct a second stream of coolant in thermal communication with each of said plurality of cylinders.

* * * * *